US011363849B2

(12) United States Patent
Reed

(10) Patent No.: US 11,363,849 B2
(45) Date of Patent: Jun. 21, 2022

(54) HELMET AND INFORMATION CARRIER

(71) Applicant: MEDICAL DATA CARRIER IM INC., Ottawa (CA)

(72) Inventor: Steven Reed, Ottawa (CA)

(73) Assignee: MEDICAL DATA CARRIER IM INC.

( * ) Notice: Subject to any disclaimer, the term of this patent is extended or adjusted under 35 U.S.C. 154(b) by 142 days.

(21) Appl. No.: 16/410,649

(22) Filed: May 13, 2019

(65) Prior Publication Data

US 2019/0261719 A1 Aug. 29, 2019

Related U.S. Application Data

(60) Continuation-in-part of application No. 15/155,698, filed on May 16, 2016, now abandoned, which is a (Continued)

(30) Foreign Application Priority Data

Feb. 3, 2012 (CA) ..... CA 2766427

(51) Int. Cl.
*A42B 1/248* (2021.01)
*A42B 3/04* (2006.01)

(Continued)

(52) U.S. Cl.
CPC ..... *A42B 3/0406* (2013.01); *G09F 3/10* (2013.01); *G09F 3/18* (2013.01); *G09F 3/20* (2013.01);

(Continued)

(58) Field of Classification Search
CPC ..... A42B 3/0406; A42B 1/241; A42B 1/24; A42B 1/248; A42B 3/0433; G09F 21/023;

(Continued)

(56) References Cited

U.S. PATENT DOCUMENTS

X231251 8/1880 Adler
1,141,603 A * 6/1915 Beltramini ..... B65D 27/30 229/82

(Continued)

FOREIGN PATENT DOCUMENTS

CN 202980305 U * 6/2013
CN 106037109 A * 10/2016

(Continued)

OTHER PUBLICATIONS

Extended European Search Report issued in European Application No. 13743968.3 dated Nov. 9, 2015, 7 pages.

(Continued)

*Primary Examiner* — Cassandra Davis
(74) *Attorney, Agent, or Firm* — Sand, Sebolt & Wernow Co., LPA

(57) ABSTRACT

A helmet including a protective head covering, information carrier, adhesive, and flap. The information carrier includes a first panel having a terminal edge, and a second panel having a fold line. The second panel is joined to the first panel to define a pouch having an interior space and an opening to the interior space. The opening is defined by the terminal edge disposed proximately to the first panel below the fold line. The adhesive is configured to affix the first panel to the exterior surface. The flap is pivotally attached to the second panel about the fold line, wherein the second panel is bendable away from the exterior surface at least between the terminal edge and the fold line to enable the flap to pivot about the fold line toward the exterior surface in connection with insertion of the flap into and removal of the flap from the opening.

10 Claims, 18 Drawing Sheets

Related U.S. Application Data division of application No. 14/376,036, filed as application No. PCT/CA2013/050079 on Feb. 1, 2013, now abandoned.

(51) Int. Cl.

| | |
|---|---|
| ***G09F 3/10*** | (2006.01) |
| ***G09F 3/20*** | (2006.01) |
| ***G09F 21/02*** | (2006.01) |
| ***G09F 3/18*** | (2006.01) |
| *G09F 3/02* | (2006.01) |

(52) U.S. Cl.

CPC ..... *G09F 21/02* (2013.01); *G09F 21/023* (2020.05); *A42B 1/248* (2013.01); *G09F 2003/0222* (2013.01)

(58) Field of Classification Search

CPC ... G09F 3/10; G09F 3/20; G09F 21/02; G09F 3/18; G09F 2003/0222

See application file for complete search history.

(56) References Cited

U.S. PATENT DOCUMENTS

| | | | | |
|---|---|---|---|---|
| 1,831,854 | A | 11/1931 | Fowler | |
| 2,289,118 | A | 7/1942 | Hatton | |
| 2,926,439 | A | 3/1960 | Holick | |
| 3,237,327 | A * | 3/1966 | Griggs | G09F 3/18 40/643 |
| 3,747,776 | A | 7/1973 | Gross | |
| 3,772,708 | A | 11/1973 | Segelin | |
| 3,879,875 | A | 4/1975 | Schneider | |
| 4,451,935 | A * | 6/1984 | Henschel | A42B 1/241 2/181 |
| 4,669,125 | A | 6/1987 | Allen | |
| 4,722,376 | A | 2/1988 | Rhyner | |
| 5,173,968 | A * | 12/1992 | Fox | A41D 27/08 2/108 |
| 5,452,479 | A * | 9/1995 | Mostert | A42B 1/248 2/195.1 |
| 5,625,904 | A | 5/1997 | Kline | |
| 6,578,757 | B1 * | 6/2003 | Espenshied | B65D 27/00 229/92.8 |
| 6,643,847 | B1 | 11/2003 | Dornak | |
| 6,751,805 | B1 | 6/2004 | Austion | |
| 7,093,305 | B2 | 8/2006 | Reilly et al. | |
| 7,401,365 | B2 * | 7/2008 | Neal | A42B 3/0406 2/209.13 |
| 8,272,507 | B1 | 9/2012 | Crump et al. | |
| 2005/0133554 | A1 | 6/2005 | Maupin | |
| 2007/0245465 | A1 | 10/2007 | Neal et al. | |
| 2009/0183301 | A1 | 7/2009 | Brown et al. | |
| 2014/0259835 | A1 * | 9/2014 | Ptak | G09F 3/201 40/651 |
| 2016/0255896 | A1 * | 9/2016 | Reed | G09F 3/20 |

FOREIGN PATENT DOCUMENTS

| | | | |
|---|---|---|---|
| CN | 206413822 | U * | 8/2017 |
| DE | 102006057244 | | 6/2008 |
| EP | 0825608 | | 2/1998 |
| FR | 2631531 | | 11/1989 |
| GB | 400098 | | 10/1933 |
| GB | 899067 | | 6/1962 |

OTHER PUBLICATIONS

International Search Report and Written Opinion issued in International Application No. PCT/CA2013/050079, dated Mar. 26, 2013, 9 pages.

* cited by examiner

HELMET AND INFORMATION CARRIER

CROSS-REFERENCE TO RELATED APPLICATIONS

This application is continuation-in-part of U.S. patent application Ser. No. 15/155,698, filed May 16, 2016, which is a divisional of U.S. patent application Ser. No. 14/376,036, filed Jul. 31, 2014, which is a U.S. 371 National Stage application of International Application No. PCT/CA2013/050079, filed Feb. 1, 2013, which claims the benefit of Canadian patent application No. 2,766,427, filed Feb. 3, 2012, all of which are hereby incorporated by reference in their entirety.

FIELD OF INVENTION

The invention relates generally to personal safety equipment, and more specifically to means for storing critical information relating to a user thereof, such as medical information and emergency contact information.

BACKGROUND

People who engage in activity in which there is an inherent risk of injury, such as riding a motorcycle, working in a hazardous workplace such as a construction site or participating in a full-contact sport, run the risk that they will be rendered unconscious or otherwise lose the ability to communicate in the event of injury. Furthermore, removal of a helmet, clothing, or other materials or equipment to access medical information carriers may itself induce further injury. Accordingly, a way of ensuring information is located in a convenient and accessible location, which should be able to carry all necessary medical information to treat an injured or ill person, wherein the information can be protected from environmental conditions and still accessed and read or otherwise obtained easily without moving the injured person, or removing clothing, equipment, or other materials, particularly those around the head, such as a helmet, is required, notably in a way in which operational impact is minimized, particularly with regard to aerodynamics, size, and conformability to different shaped surfaces, which is currently not addressed. In such a case, emergency responders may not be able to access critical information that is required to assist the injured person, such as medical information or emergency contact information.

It is therefore known in the art to provide means by which medical information and emergency contact information can be recorded and stored on one's person, in a conspicuous area such that it is easily discoverable by a first responder. One example of such means is disclosed in U.S. Pat. No. 7,401,365 granted to Neal et al. Neal discloses an emergency information system for a helmet, such as a bicycle helmet or motorcycle helmet including a sleeve having an open end and an information card for bearing medical and emergency contact information. The information card can be removably inserted into the sleeve through the open end. The sleeve can be affixed to an exterior surface of the helmet, such that the information card containing medical or emergency contact information can be stored on the exterior surface of a helmet. The sleeve also can include a decal bearing indicia indicating to first responders that the information card (containing important medical and emergency contact information) is present.

Other similar examples of such means are generally available on the market. One example of such means is illustrated in FIG. 1. The means shown in FIG. 1 comprises a pouch that is can be affixed to a motorcycle helmet (although similar pouches intended to be affixed to other types of helmets, such as hardhats, also are generally available) and an information form onto which medical and emergency contact information can be recorded. The pouch forms an interior space and an opening that allows access to the interior space from outside the pouch. The information form can be folded such that it can be inserted into the interior space of the pouch via the opening. As well, a flap extends from the pouch near the opening and can be folded over and inserted into the opening, to close off the opening of the pouch. When the information form is folded and inserted in the interior space and the flap is folded over and inserted into the interior space, the flap serves as a closure mechanism enclosing the information form within the interior space.

The pouch shown in FIG. 1 has an indicia printed on the outer half of the pouch (i.e., the portion that is not affixed to the helmet) informing first responders that medical and emergency contact information is contained within the pouch. The indicia also warn potential untrained first responders of the dangers of removing the helmet of an injured person in certain circumstances.

The flap shown in FIG. 1 extends from the inner half of the pouch, that is, the half of the pouch that is affixed to the helmet. Therefore, to close off the opening of the pouch, the flap is folded outwardly, away from the helmet before being folded over and inserted into the opening. Flaps such as these have been known to unexpectedly and unintentionally open, particularly when the pouch is affixed to the helmet such that the opening and flap are towards the rear of the helmet. In such cases, as air flows over the surface of the helmet from the front of the helmet towards the rear, portions of the underside of the flap that are exposed may catch some of the air flowing over the helmet, which may cause the flap to be pulled out of the opening. Particularly, when such pouches do not conform well to such surfaces. When this happens, accidental loss of the information form, or the pouch itself, contained in the pouch may result. In addition to improved configuration of openings and closing mechanisms, improvements in how such pouches are secured to, and conform with, non-standard surfaces are required.

Similar and other issues may be exacerbated by current construction methods, either alone or in association with some of the other drawbacks of the current state of the art. Materials that are more optimal for

SUMMARY OF THE INVENTION

The invention provides an information carrier comprising a pouch for storing critical information, such as medical information or emergency contact information that can be affixed to an object such as an article worn by the user (for example, a helmet or a jacket), or equipment used by the user (e.g. a motorcycle). The pouch has a flap that can close the opening to the pouch by folding inwardly, toward the helmet or other item to which the pouch is affixed, and then being inserted into the opening.

According to one embodiment, the invention provides an information carrier, comprising a pouch having an inwardly-facing first exterior surface and an outwardly-facing second exterior surface, the pouch forming interior space and an opening thereto, adhesive means for affixing the first exterior surface to an object, and a flap pivotally attached to the second exterior surface proximate the opening, for pivoting toward the first exterior surface and insertion into the opening.

According to another embodiment, the invention provides a kit of parts, including a pouch having an inwardly-facing first exterior surface and an outwardly-facing second exterior surface, the pouch forming interior space and an opening thereto, adhesive means for affixing the first exterior surface to an object, and a flap pivotally attached to the second exterior surface proximate the opening, for pivoting toward the first exterior surface and insertion into the opening, and an information form for being removably held within the interior space.

According to another embodiment, the invention provides a helmet including a protective head covering having an exterior surface, and a pouch having an inwardly facing exterior surface affixed to the exterior surface of the helmet, the pouch further having an outwardly facing exterior surface, an interior space, an opening thereto and a flap pivotally attached to the second exterior surface proximate the opening, for pivoting toward the exterior surface of the helmet and insertion into the opening.

According to another embodiment, there is provided a helmet including a protective head covering having an exterior surface; and an information carrier. The information carrier includes a first panel and a second panel joined to define a pouch having an interior space and an opening thereto. The first panel has a first exterior surface and the second panel has an outwardly-facing second exterior surface. The information carrier includes adhesive means applied to the first exterior surface of the first panel for affixing the first panel to the exterior surface of the protective head covering; and a flap pivotally attached to the second exterior surface of the second panel proximate the opening, for pivoting the second panel toward the exterior surface of the protective head covering and insertion into the opening.

According to another embodiment, there is provided a helmet including a protective head covering having an exterior surface; and an information carrier. The information carrier has a first panel and a second panel joined to define a pouch having an interior space and an opening thereto. The first panel has a first exterior surface and the second panel has an outwardly-facing second exterior surface. The information carrier includes adhesive means applied to the first exterior surface for affixing the first panel to the exterior surface of the protective head covering; and a flap attached to the second exterior surface of the second panel proximate the opening, for pivoting the second panel toward the exterior surface of the protective head covering and for insertion into the opening, wherein the flap is tapered from the second exterior surface to an end of the flap such that the opening is wider than the end of the flap for ease of insertion of the flap into the opening.

According to another embodiment, there is provided a helmet having a front and a rear, and including a protective head covering, information carrier, adhesive, and flap. The information carrier includes a first panel having a terminal edge, and a second panel having a fold line. The second panel is joined to the first panel to define a pouch having an interior space and an opening to the interior space. The opening is defined by the terminal edge disposed proximately to the first panel below the fold line. The adhesive is configured to affix the first panel of the information carrier to the exterior surface of the protective covering. The flap is pivotally attached to the second panel about the fold line, wherein the second panel is bendable away from the exterior surface at least between the terminal edge and the fold line to enable the flap to pivot about the fold line toward the exterior surface in connection with insertion of the flap into and removal of the flap from the opening.

DETAILED DESCRIPTION OF EMBODIMENTS

Figure 2:
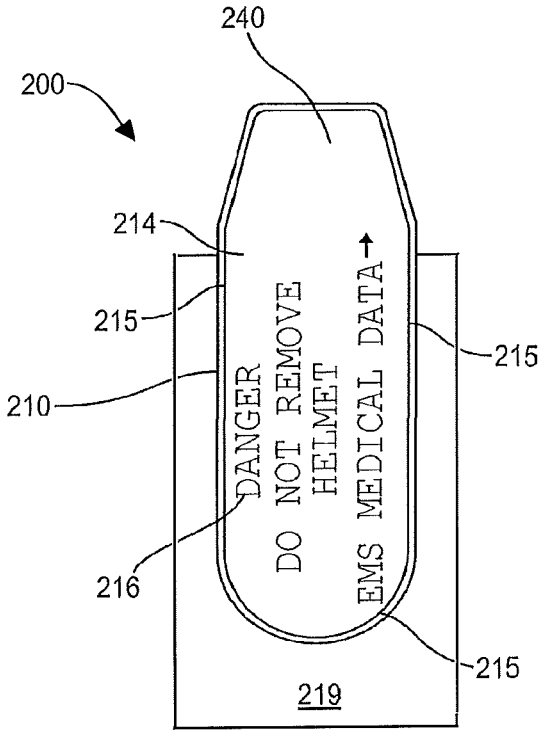
FIG. 2 is a front view of one embodiment of the medical information carrier of the present invention.
Figure 3:
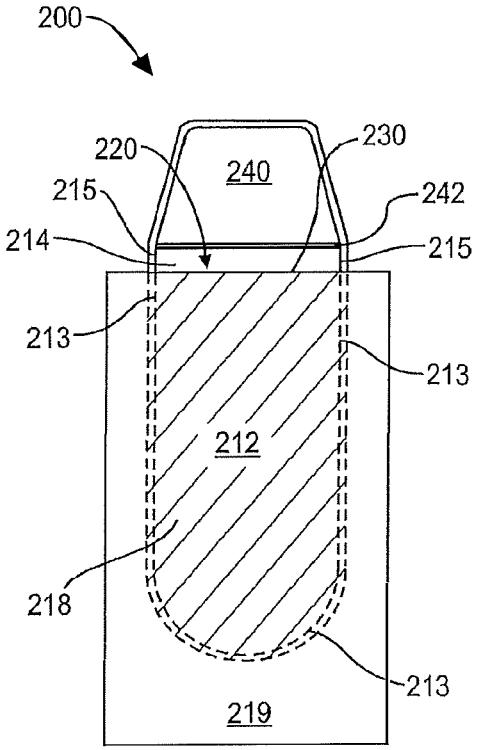
FIG. 3 is a rear view of the embodiment shown in FIG. 2.
Figure 6:
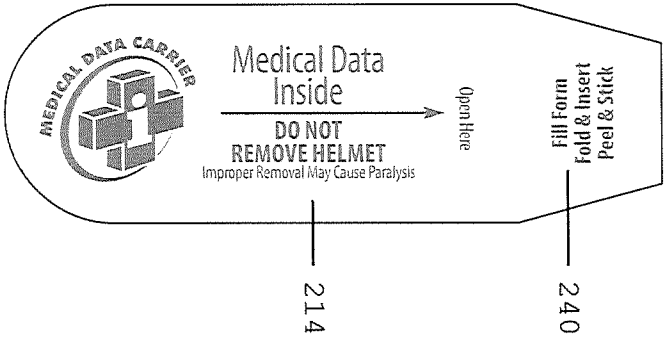
FIG. 6 is a front view of the embodiment of the medical information carrier of the present invention from FIG. 2, shown in isolation.
Figure 7:
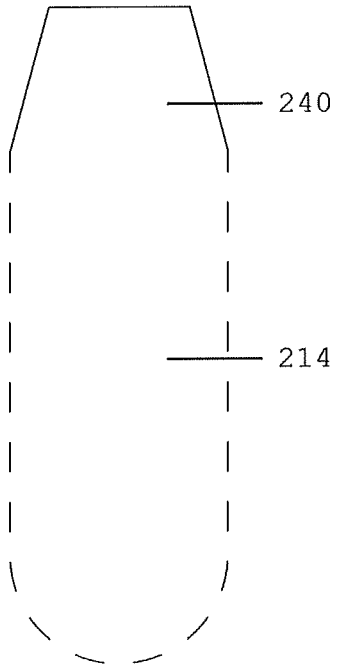
FIG. 7 is a front view of the embodiment of the medical information carrier of the present invention from FIG. 2, shown in isolation and with a portion of the embodiment shown in broken lines.
Figure 8:
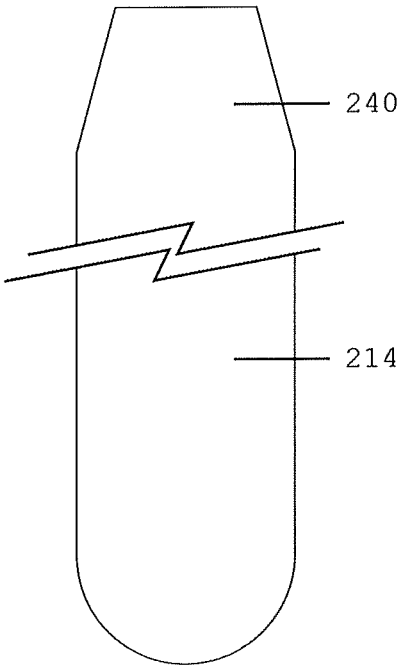
FIG. 8 is a front view of the embodiment of the medical information carrier of the present invention from FIG. 2 of indefinite length.

FIGS. 2 and 3 show one embodiment of the information carrier 200 of the present invention. The carrier 200 has a pouch 210, which forms an interior space 220 and an opening 230, and a flap 240. FIGS. 6, 7, and 8 show the same embodiment of the information carrier pouch 210, with certain features emphasized or shown with indefinite length.

Figure 9:
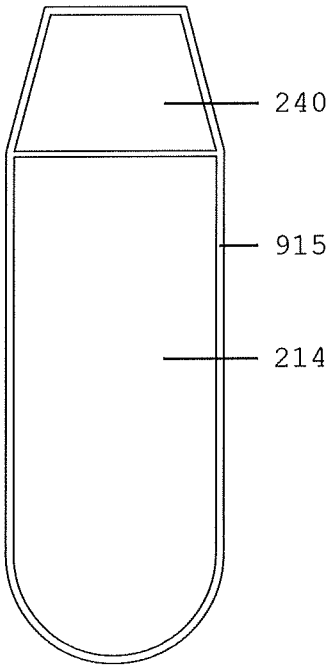
FIG. 9 is a front view of the embodiment of the medical information carrier of the present invention from FIG. 3, shown in isolation.
Figure 10:
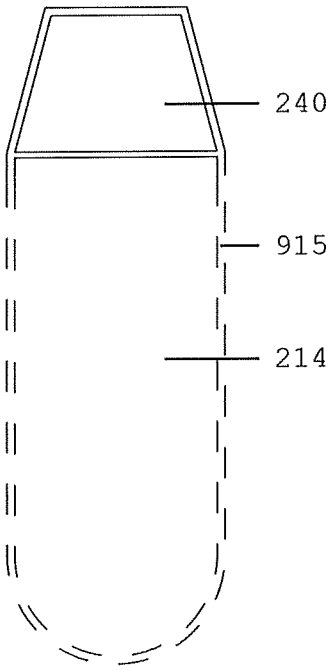
FIG. 10 is a front view of the embodiment of the medical information carrier of the present invention from FIG. 3, shown in isolation and with a portion of the embodiment shown in broken lines.
Figure 15:
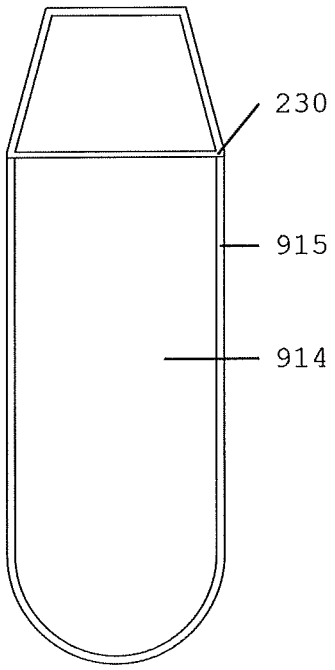
FIG. 15 is a rear view of the embodiment of the medical information carrier of the present invention from FIG. 3, shown in isolation.

FIGS. 9 and 10 show this embodiment with the edge features, as a whole and with certain features emphasized. FIG. 15 shows the view of FIG. 9 but from the rear.

The pouch 210 is formed by adhering a first, inwardly facing panel 212 and a second, outwardly facing panel 214, arranged in opposing arrangement, along a portion of edge regions 213, 215 thereof. Adhering the first and second panels 212, 214 in this manner thus forms the interior space 220 in between the panels 212, 214, as well as the opening 230 which allows access to the interior space 220 from outside the pouch 210.

Figure 16:
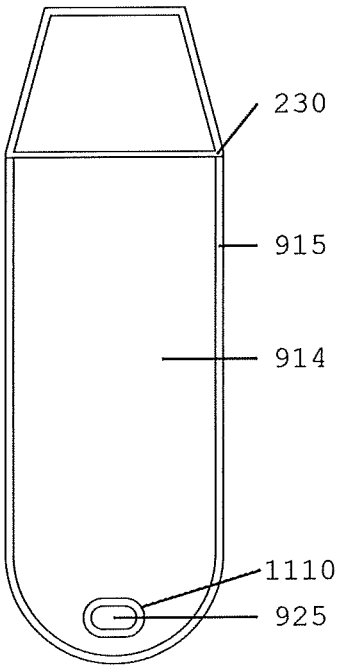
FIG. 16 is a rear view of the embodiment of the medical information carrier of the present invention from FIG. 11, shown in isolation.
Figure 17:
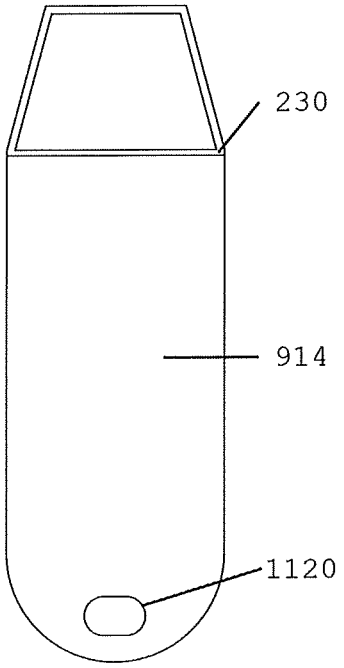
FIG. 17 is a rear view of the embodiment of the medical information carrier of the present invention from FIG. 13, shown in isolation.

In some embodiments, the edge regions and/or the fold line may compose of different, or differently processed material. For example, in FIG. 2 the edge region 215 may be pressed under heater conditions as a way of adhering multiple layers together, in part to prevent water or other liquids from entering the interior of the pouch, but also different materials may be used for the panels 240, 214, 914 than for the edge regions 215, 915 and/or the fold lines 242. This may provide for lighter weight material, particularly if the material of the panels 240, 214, 914 has specific requirements, such as, being: suitable for printing material thereon, highly visible, pliant, reflective, suitable for maintaining adhesion to removable adhesive strip (or replacements thereof), resilient, or combinations thereof; these may be particularly important when these characteristics are not compatible with characteristics that are required or beneficial for the edge regions 215, 915 and/or fold lines 242, such as sealability. In addition, edge regions 215, 915 may also be used to seal different materials required for the panels 240, 214, 914 together, as the top panel may require certain characteristics that are different or incompatible with those of the rear panel. For example, embodiments of the instantly disclosed subject matter may utilize material on the top panel that is suitable for printing material thereon, as well as high visibility, but the rear panel requires strong adhesive characteristics, particularly in association with re-usable and/or double-sided adhesives, or magnetic force. Referring to FIGS. 15, 16, and 17, for example different material for rear panel 914 may be used from the front panel 214.

The panels 212 and 214 are made from vinyl or similar material, which makes the pouch 210 generally waterproof. This is useful, particularly when the pouch 210 is to be adhered to a helmet for use outdoors such as a motorcycle helmet. However, any suitable lightweight waterproof or water resistant material can be used to form the panels 212, 214, such as plastics or other alternatives known in the art. By using a different material, or by applying different processing applications to the fold line regions 242, the pouch 210 can be closed by folding along a line that is immediately adjacent to or coincident along the opening, and thereby ensuring a very tight waterproof seal ensuring integrity of the materials inside the pouch 210. In some embodiments, the exterior facing side of the front of the above-fold panel 240 having a surface that engages with the interior facing side of the rear panel 914 so as to improve water impermeability of the pouch 210. In some cases, there is a covering material, e.g. vinyl, for holding in place material used for the front panel 214 and above-fold panel 240 that covers another material for those panels 214, 240 thereby forming a void space at the edge regions 215, 915 and/or fold line 242 that is pressed together, or against with the panel material is pressed, so as to ensure that the panels comprise a first material with a first set of one or more characteristics, while maintaining the edge regions and edge regions 215, 915 and/or fold line 242 with different characteristics. This reduces cost of manufacture, but also ensures proper performance characteristics with the appropriate locations on the pouch 210. This also causes the pouch to form a generally low-profile parabolic shape on the exterior thereof, thereby forming an optimally low aerodynamic drag shape.

Figure 11:
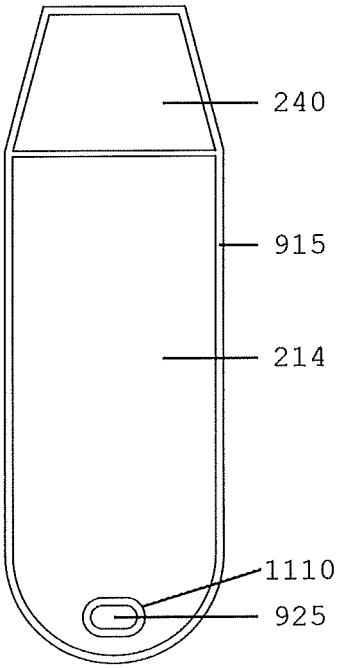
FIG. 11 is a front view of another embodiment of the medical information carrier of the present invention.
Figure 12:
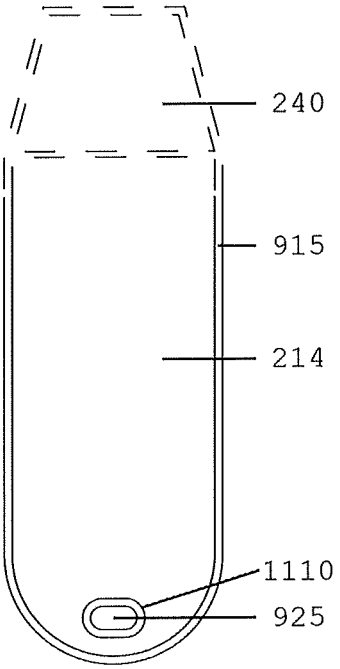
FIG. 12 is a front view of the embodiment of the medical information carrier of the present invention of FIG. 11, shown in isolation and with a portion of the embodiment shown in broken lines.
Figure 13:
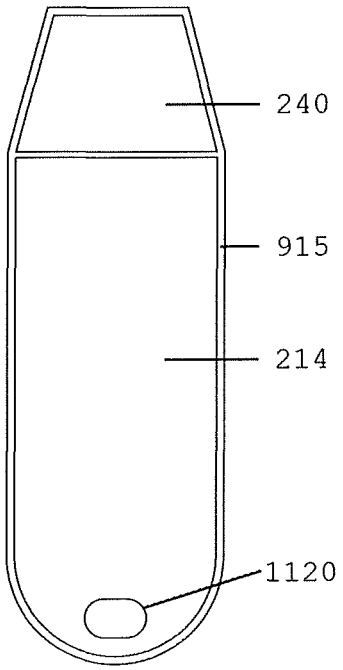
FIG. 13 is a front view of another embodiment of the medical information carrier of the present invention.
Figure 14:
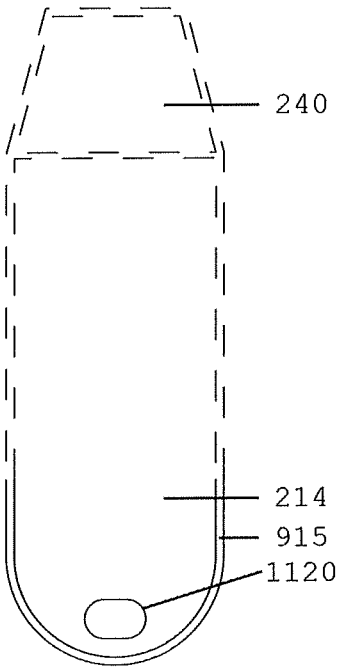
FIG. 14 is a front view of the embodiment of the medical information carrier of the present invention of FIG. 13, shown in isolation and with a portion of the embodiment shown in broken lines.

The differently processed and/or different materials of the edge regions may be more suitable for breaking or tearing along a predetermined location. This is particularly helpful during manufacturing (for separating adjacently formed pouches), removing tabs or holes (such as the closed pass-through opening 1110 location configured for holding tie-down loops or straps for securing to clothing or equipment), or opening the pouch quickly in exigent circumstances. Referring to FIGS. 11, 12 (broken line view) and 16 (a rear view), there is a first embodiment of pouch disclosed in accordance with the subject matter hereof, in which a removable hole or pass-through portion 1110 is fashioned into the lower portion of the pouch to allow for the use of a cable, tie-down, strap, or other connection means for securing the pouch to a subject's person, equipment or clothing. The edge region of the pass-through opening 925 is created by sealing the circumferential portion thereof sufficient for both sealing and, at a central portion of such edge region 915, weakening for removal. The weakening and removal may occur in different or the same process during manufacture. In other cases, as shown in FIGS. 13, 14, and 17, the pass-through 1120 is removed at the same time as sealing.

The panels 212 and 214 are of generally rectangular shape, with one of the two shorter sides being rounded, rather than straight. The first panel 212 has a length that is approximately twice the width, preferably 65.0 mm and 30.0 mm wide. The second panel 214 also has a length that is approximately twice the width, but is somewhat longer than the first panel 212. Preferably, the second panel 214 is 70.0 mm long and 30.0 mm wide. Such dimensions result in the formation of an interior space 220 having dimensions that substantially correspond with those of the first panel 212, and an opening 230 being 30.0 mm across. Such dimensions are suitable for receiving and storing an information form. However, the panels 212 and 214 need not be rectangular, and can have other dimensions, so long as the pouch 210, interior space 220 and opening 230 remain of a suitable size for both (a) mounting on a helmet or other personal safety equipment, and (b) receiving and storing an information form.

The panels 212, 214 are adhered to one another using any suitable method for joining vinyl to form a waterproof seal. Alternatively, the panels 212 and 214 can be joined in any other way such that an interior space 220 is formed (i.e., the seal between the panels 212, 214 does not have to be waterproof). As well, other methods for adhering the panels 212, 214 may be appropriate when the panels 212, 214 are of an alternative material other than vinyl.

The outwardly facing second panel 214 has an inscription 216 printed on its exterior surface (i.e., the surface that is not within the internal space 220). The inscription 216 serves two main purposes. First, the inscription 216 informs first responders that critical information relating to the victim of the accident, such as medical information or emergency contact information, is located within the pouch 210. Second, the inscription 216 warns first responders that may not have formal medical or first aid training about potentially dangerous courses of action. For example, when the information carrier 200 is affixed to a motorcycle helmet, the inscription 216 comprises a warning that removal of the helmet from the victim may, under certain circumstances, result in paralysis. Materials for the pouch may be chosen to simultaneously: (1) increase the adhesion (and/or provide a surface that can be removably applied with an adhesive material or strip while still maintaining strong adhesion) on the rear side, (2) maintain low aerodynamic drag, high visibility and/or ease of printing on the front side, and (3) have high overall pliability of the pouch to ensure conformance with uneven surfaces on a subject's equipment or clothing. In some embodiments, the front panels 214, 240 may be made of, or have specific materials applied thereto, that provide for good application of printed subject matter, and ease of use with printing devices. In one embodiment, a fine mesh is applied to the exterior facing side of the front panel 214 to provide for appropriate and controllable adherence by a printer mechanism, while maintaining good printability (i.e. absorption characteristics) by the material under the mesh.

The inscription 216 also may contain other information appropriate to the specific application in which the information carrier 200 is being used. As well, the inscription 216 may contain information in a format other than written language. By way of example, the inscription 216 may comprise a scannable code, such as a QR code or a bar code of any kind (either single dimension or multi-dimensions), that can be scanned by a mobile device of a first responder and direct the mobile device to display pertinent medical or emergency contact information (or both). In some cases, the pouch 210 may comprise an RFID tag that comprises information that is obtainable without removing or moving the tag in any way. Other technologies, both RF-based and visual (e.g. bar codes or QR codes), may be used to transfer information from the pouch 210 to a reader of such RF-based transmission or visual indicia (e.g. bar code or QR code). This may provide a link a network or telephonically accessible source of information. This provides a mechanism for amending information without removing and changing the pouch 210, since medical or other information (e.g. address, point of communication, etc.) can be stored centrally elsewhere (e.g. in a network-enabled data repository and/or in a cloud-based data repository) and the pouch-based information provides a connection or information that facilitates connection to that central repository upon demand. The pouch-based information would provide authentication and/or credentialing information specific to the pouch that would ensure that only requests having or accessed from the pouch-based information would be accepted by the central data repository.

The information carrier 200 also comprises adhesive means 218 for affixing the information carrier 200 to an object such as an article worn by the user (for example, a helmet or a jacket), or equipment used by the user (for example, a motorcycle). Adhesive means 218 comprises a layer of pressure-sensitive adhesive, commonly known in the art as "PSA", applied to the outer surface of the inwardly facing first panel 212 (i.e., the surface not contained within the interior surface 220). The PSA layer 218 covers substantially all of the outer surface of the inwardly facing first panel 212, although the PSA layer 218 can be of reduced area.

A sheet of release paper 219 is applied over the PSA layer to preserve the PSA layer until the information carrier 200 is to be affixed to an object such as an article worn by the user (for example, a helmet or a jacket), or equipment used by the user (for example, a motorcycle). The release paper 219 is 79.0 mm long, and 42.7 mm wide, although any dimensions suitable for covering the entirety of the PSA layer 218 are acceptable.

It will be readily apparent to those of ordinary skill in the art that the adhesive means 218 can comprise any suitable alternative to a PSA layer that can effectively hold the information carrier 200 to the article or equipment to which the information carrier 200 is to be affixed. For example, the adhesive means 218 can comprise a piece of Velcro™ designed to adhere to a corresponding piece of Velcro™ affixed to the article or equipment to which the information carrier 200 is to be affixed. Those skilled in the art will appreciate that other examples are possible.

The adhesive means 218 may be a non-integral adhesive, such as a strip of two-sided adhesive with release paper on both sides. This improves pliability for surface conformance, since other materials for the rear panel 214 of the pouch 210. It also means that a pouch can be re-used, particularly when the rear panel 214 comprises a material configured for repeated applications of different adhesive strips.

The information carrier 200 further comprises a flap 240 for selectively closing the opening 230 to the interior space 220. The flap 240 is an integral piece of the outwardly facing second panel 214 that extends in the plane formed by the second panel 214 from the edge region of the second panel 214 that is adjacent to the opening 230. The flap 240 has a length of 20.0 mm. The width of flap 240 is 30.0 mm at the second panel 214, and tapers slightly along the length of the flap 240.

The intended function of the flap 240 is to be folded over towards the opening 230 and inserted into the opening 230 to selectively close the opening 230. To facilitate such folding, a fold line 242 is provided between the flap 240 and the remainder of the second panel 214. The fold line 242 comprises a linear region in which the vinyl material that forms both the second panel 214 and the flap 240 is thinner than in the remainder of the flap 240 and second panel 214. The fold line 242 extends across the entire width of the flap 240 and second panel. The fold line 242 facilitates easier pivoting or folding of the flap 240 relative to the panel 214, about the axis formed by the fold line 242.

Those of skill in the art will appreciate that the flap 240 can be formed in alternative ways. For example, the flap 240 can simply be an extension of the second panel 214, and does not need to be demarcated with a fold line such as fold line 242 (so long as the material from which the second panel 214 and flap 240 is made is foldable). By way of another example, the flap 240 does not need to be an integral part of the second panel 214. Rather, the flap 240 can be a separate piece of material pivotally attached to the second panel 214 proximate the opening 230 such that the flap 240 can be folded over and inserted into the opening 230 to close the opening 230. Flap 240 can be made of any suitable material from which the first and second panels 212, 214 can be made, and can be of any dimensions such that the flap can be inserted into the opening 230 to close the substantially opening 230.

Figure 4A:
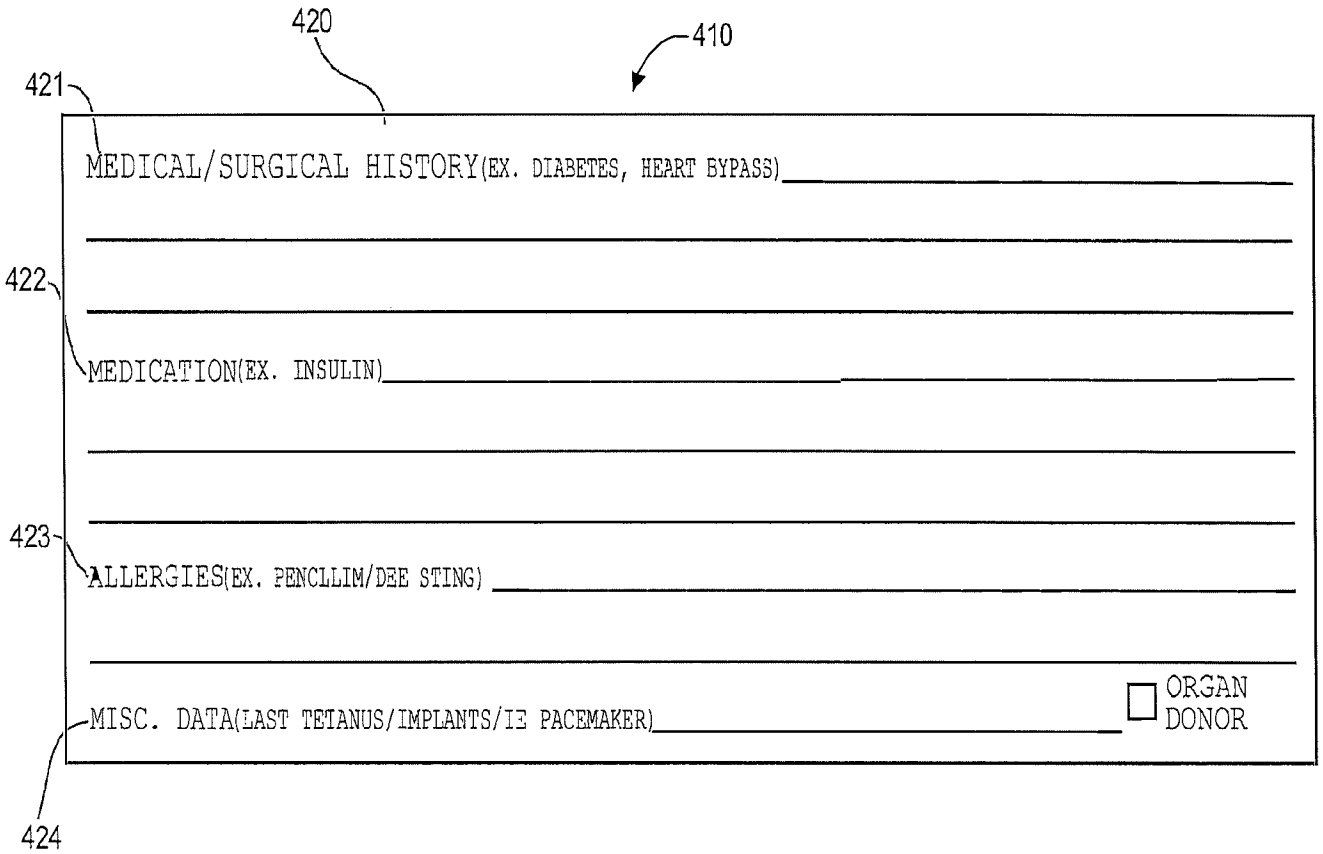
FIG. 4*a* is a front view of one embodiment of an information form, for use with the medical information carrier of the present invention.
Figure 4B:
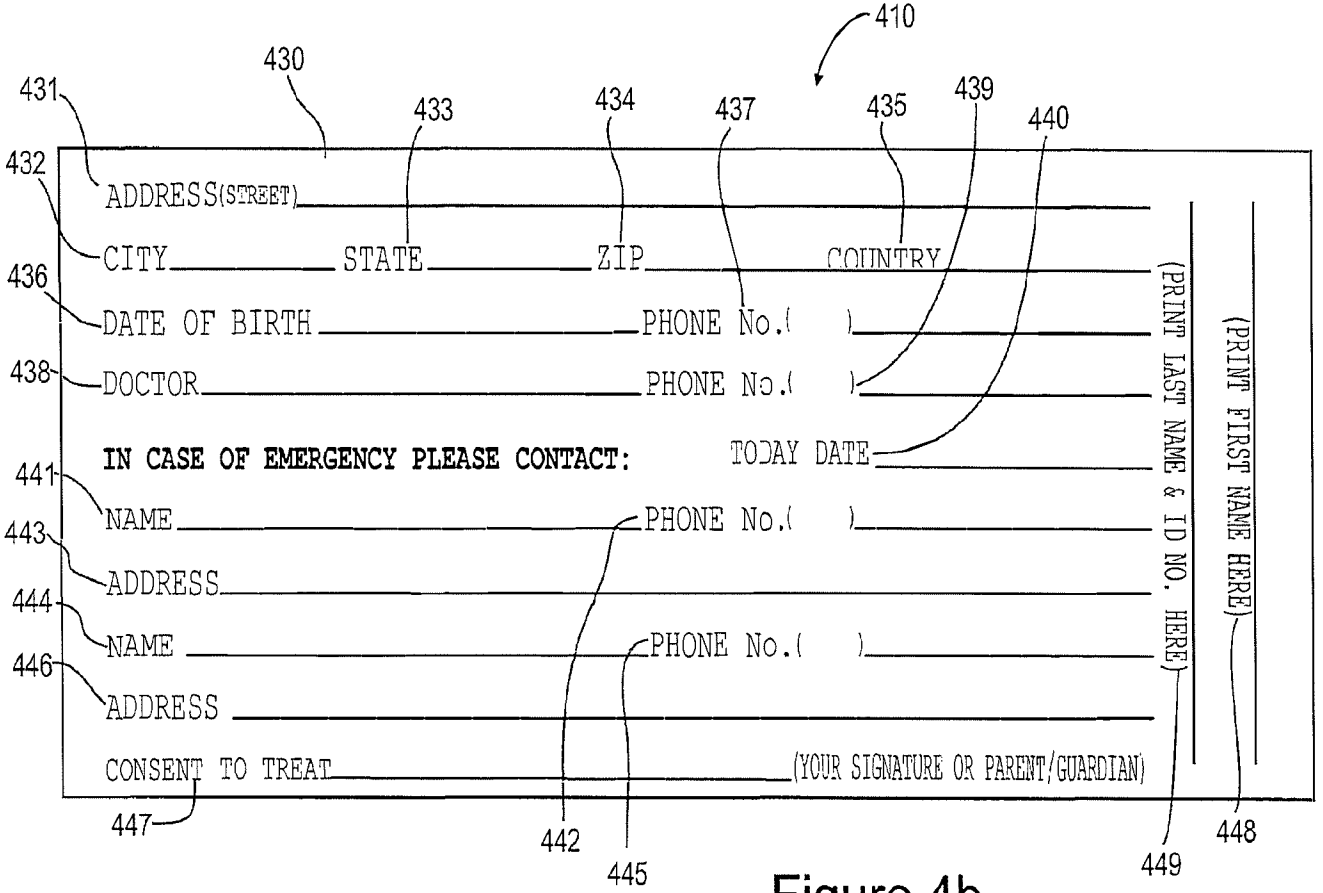
FIG. 4*b* is a rear view of the embodiment of an information form shown in FIG. 4*a*.

Referring now to FIGS. 4*a* and 4*b*, an information form 410 is provided for insertion into the interior space 220 via the opening 230, and for having critical information regarding the user of the information carrier 200 recorded thereon. Information form 410 is made from synthetic paper, which is both tear resistant and waterproof. Information form 410 has a length of 117.5 mm and a width of 44.5 mm. While information form 410 cannot be directly inserted into the interior space 220, information form 410 can easily be folded to occupy dimensions such that the information form 410 can be inserted into the interior space 220 via the opening 230.

FIG. 4*a* shows a first side 420 of the information form 410. Several fields are printed on the first side 420 of information form 410. Each of these fields relates to medical information of the user of the information carrier 200, and can be completed by the user by filling in the pertinent information by hand. The first side 420 of information form 410 contains the following fields: Medical/surgical history 421; Medications 422; Allergies 423; Misc. data 424.

FIG. 4*b* shows a second side 430 of the information form 410. Several fields are printed on the second side 430 relating to emergency contact information of the user of the information carrier 200. These fields can be completed by the user by hand. The second side 430 of information from 410 contains the following fields:

Address (Street) 431;
City 432;
State 433;
ZIP 434;
Country 435;
Date of Birth 436;
Phone No. 437;
Doctor 438;
Doctor's Phone No. 439;
Today's Date 440;
Emergency Contact #1 Name 441;
Emergency Contact #1 Phone Number 442;
Emergency Contact #1 Address 443;
Emergency Contact #2 Name 444;
Emergency Contact #2 Phone Number 445;
Emergency Contact #2 Address 446; and
Consent to Treat 447.

It will be appreciated by those of skill in the art that information form 410 can be made from any material suitable for writing thereon, or for otherwise printing information thereon. Information form 410 can be made of any suitable dimensions whereby the information printed thereon can be easily read, and the information form 410 can be inserted into the interior space 220 via the opening 230. The information form 410 need not be made from a foldable material so long as information form 410 has dimension that allow it to be directly inserted into the interior space 220 via the opening 230.

It also will be appreciated by those of skill in the art that the various fields on either side 420, 430 of the information form 410 can be arranged in essentially any configuration, and can relate to any piece of information that may be deemed important. As well, the information recorded on the information form 410 need not be recorded in written language. For example, the information form 410 can contain a scannable code, such as a QR code or a bar code of any kind (either single dimension or multi-dimensions), that can be scanned by a mobile device of a first responder to direct the mobile device to display information relevant to the user of the information carrier 200.

Figure 5:
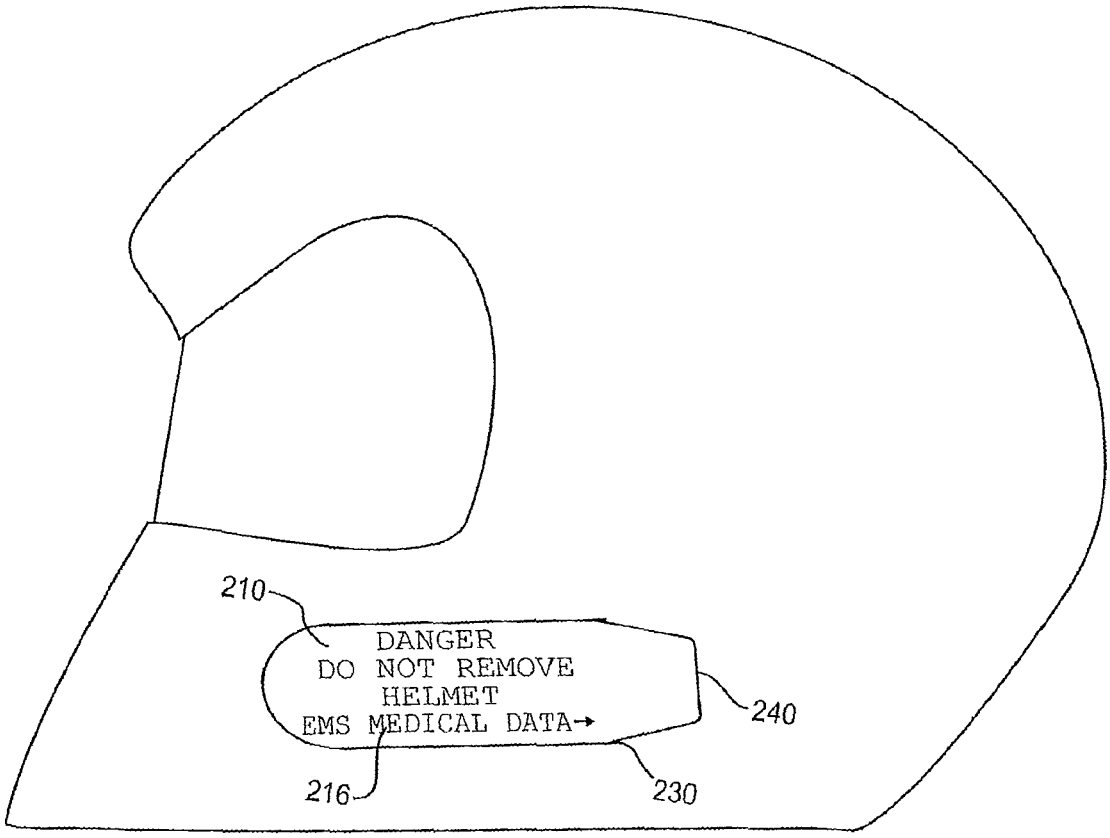
FIG. 5 is a side view of the embodiment shown in FIG. 1, shown mounted on a motorcycle helmet.

In use, the pouch 210 is first affixed to an object such as an article worn by the user (for example, a motorcycle helmet as shown in FIG. 5), or equipment used by the user. The pouch 210 is affixed to the helmet by removing the release paper 219 from the PSA layer 218 and pressing the inwardly facing first panel 212 against the exterior surface of the helmet, thereby adhering the pouch to the helmet. The release paper 219 is then discarded. Although not required, the pouch 210 can be adhered to the helmet such that the opening 230 is arranged toward the rear side of the helmet. It will be explained in greater detail below that such a configuration allows the flap 240 to be better retained within the opening 230, thereby guarding against unintended opening of the flap 240 and opening 230.

The information form 410 is completed by the user, who provides all pertinent medical and emergency contact information in the fields provided. The information form 410 is then folded as necessary and inserted into the interior space 220 via the opening 230.

Figure 1:
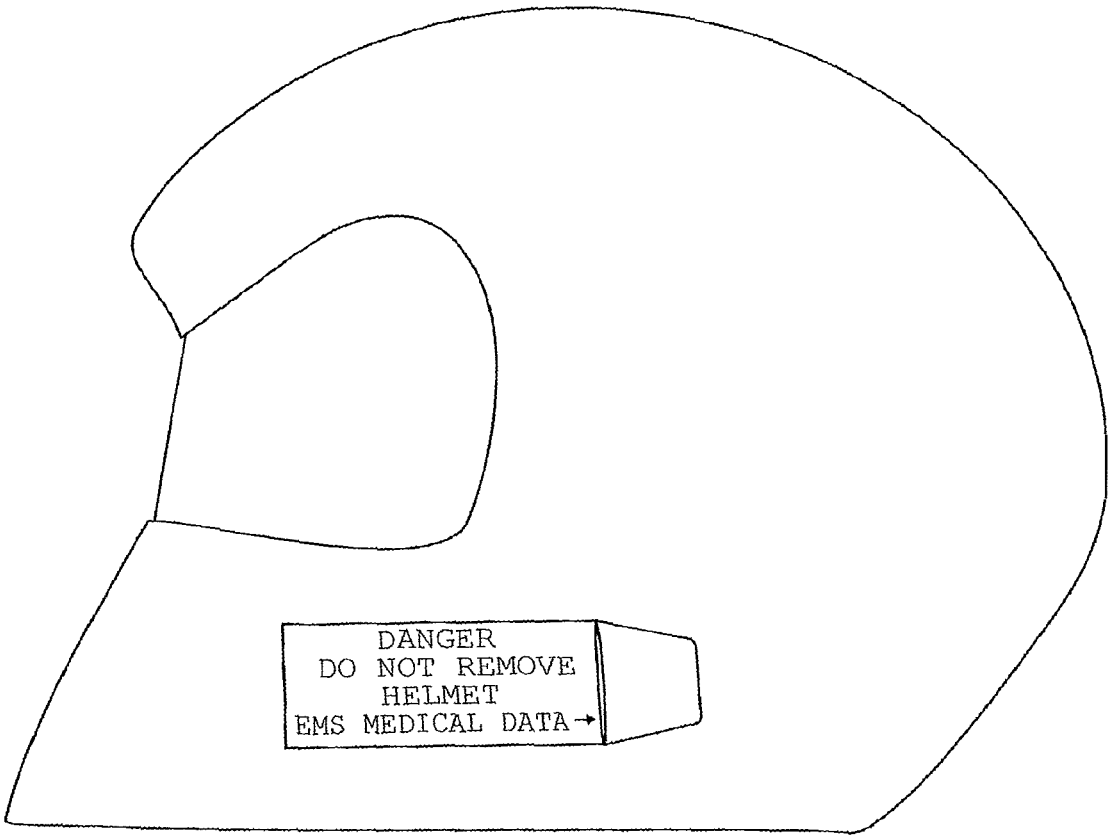
Figure 1 Prior Art
FIG. 1 is a perspective view of a means for storing medical and emergency contact information on a helmet that is known in the prior art.

Once the information form 410 has been placed within the interior space 220, the flap 240 can be folded and inserted into the opening 230 to close off the opening 230 and retain the information form 410 within the pouch 210 during use of the helmet by the user. To close off the opening 230, the flap 240 is folded inwardly, toward the outer surface of the helmet, rather than away from the outer surface of the helmet. The flap is then folded over and inserted into opening 230, thereby closing off the opening 230. When flap 240 is folded over and inserted into opening 230 in this manner, air moving over the exterior surface of the helmet can more easily pass over the information carrier 200, improving the aerodynamic performance of the helmet relative to a helmet having affixed thereto a means for storing information such as that shown in FIG. 1. As well, when the information carrier 200 is positioned such that the flap 240 and opening 230 are positioned toward the rear of the helmet (as shown in FIG. 5) the flap 240 is less likely to be caught by the wind and inadvertently be withdrawn from the opening 230 since the force of the wind moving over the surface of the helmet will resist the pivotal movement of the flap 240 out of the opening 230.

In the event of an emergency such as a motorcycle accident, first responders to the incident can see the information carrier 200 affixed to the helmet of the accident victim, as well as the inscription 216. The inscription 216 directs first responders to the information form 410 contained within the pouch 210. First responders can then remove the flap 240 from the opening 230 and retrieve the information form 410 from the interior space 220 of the pouch 210, giving first responders access to critical information regarding the accident victim. Such information may not otherwise be available to the first responders if the accident victim is not able to communicate such information himself.

The inscription 216 also directs first responders not to remove the helmet of the accident victim, since such removal may cause paralysis. First responders who are medically trained will know, by virtue of their training, when it is safe to disregard this warning and remove the helmet. On the other hand, first responders who are not medically trained will be inclined to heed the warning given by the inscription 216 and leave the helmet on the accident victim until skilled emergency responders arrive on scene. Helmets and other protective equipment are often worn in the context of risky or dangerous activities in which the wearer of that equipment may become injured. Such injuries may be exacerbated by moving the subject's head or other body parts, including by increasing the risk of paralysis. Accordingly, embodiments hereof are configured to permit access to medical information, without assistance or communication with the injured person, and without moving the person as would be required if removal of a helmet or other protective equipment or clothing upon which the pouch 210 may be attached. Moreover, the instantly disclosed pouch 210 may be configured to minimize operational impact when secured thereto prior to it being accessed by those providing medical assistance, while ensuring that the information is protected from environmental elements.

It should be understood by those having ordinary skill in the art that the foregoing describes one embodiment of the present invention only, and that other embodiments are possible. For example, the dimensions of the information carrier 200 and its component parts may vary, and assume any size appropriate to perform the function described above. As well, while the information carrier 200 has been described as generally rectangular in shape, other shapes are possible.

Furthermore, the particular assembly method described above may be varied. For example, the pouch 210 can be a single integral piece of material forming an interior space 220 with an opening 230, and having a flap extending from an outwardly facing portion of the pouch 210, rather than being formed from two discreet panels adhered together. Seams and/or folding portions are thinner, pressed together; other parts are thicker so as to have additional visual, firmness, and printing characteristics, as well as an improved ability for printers and other manufacturing equipment to maintain precise control, while retaining visibility and printability characteristics.

As well, the manner in which critical information is recorded and stored in the information carrier 200 also can be varied. By way of example, critical information can be encoded electronically and stored on a microchip, which is retained within the pouch 210. Such information can be accessible via wireless devices used by first responders. Such information also can be accessible by physically removing the chip from the pouch 210, and connecting the chip to a mobile electronic device.

While the information carrier 200 has been described as being affixed to a helmet during use, it should be understood that the information carrier 200 can alternatively be affixed to other articles of clothing worn by a user, such as a jacket. Furthermore, the information carrier 200 can alternatively be affixed to equipment being used by the user, such as a motorcycle being ridden by the user.

The present invention should not be understood as being limited to use by riders of motorcycles. The information carrier 200 can be used by anyone who engages in activities wherein there is a risk of injury. By way of example, the information carrier 200 can be used by bicycle riders, construction workers, firefighters, users of all-terrain vehicles, participants in contact sports or participants in other sports wherein there is a risk of injury (such as skiing, snowboarding, whitewater rafting or skydiving). Numerous other applications may be possible.

It should further be understood by those having ordinary skill in the art that certain adaptations and modifications of the described embodiments can be made (other than those explicitly described above), consistent with and without departing from the present disclosure. Unless otherwise indicated, the embodiments described in the disclosure shall be understood to be non-exclusive of each other such that any embodiment can include different features of other embodiments. Therefore, the above discussed embodiments are considered to be illustrative and not restrictive. Other embodiments consistent with the present disclosure will become apparent from consideration of the specification and the practice of the present disclosure taught and suggested herein. Accordingly, the specification and the embodiments disclosed therein are to be considered exemplary only, with the true scope and spirit of the present disclosure being identified in the following claims.

I claim:

1. A helmet having a front and a rear, the helmet comprising:

a protective head covering adapted to be worn on a head of a wearer, said protective head covering having an exterior surface, said exterior surface characterized by at least one uneven surface; and an information carrier comprising:

a first panel affixed to said exterior surface of the protective head covering and having a terminal edge, said first panel being flexible; and a second panel being longer in length than said first panel and extending beyond the terminal edge of the first panel, said second panel having a fold line, the second panel being flexible and joined to the first panel to define a pouch having an interior space and an opening to the interior space, the opening defined by the terminal edge disposed proximately to the first panel below the fold line;

an adhesive on substantially all of an exterior face of said first panel wherein said adhesive is configured to conformably affix the first panel of the information carrier to an accessible location on the exterior surface of the protective head covering thereby being configured to cause the information carrier to substantially conform to the at least one uneven surface when applied thereto; and a flap that is flexible and pivotally attached to the second panel about the fold line, the second panel bendable at least between the terminal edge and the fold line to enable the flap to deformably pivot about the fold line toward the exterior surface of the protective head covering in connection with insertion of the flap into the opening for securing said pouch, wherein, when said flap is inserted in said opening, said flap having a surface that engages with a surface of said first panel for forming a waterproof seal immediately adjacent to or coincident along the opening to render the interior space of said pouch impermeable to water, and removal of the flap from the opening for accessing said pouch in said accessible location, wherein said accessible location permits removal of the flap for access to the interior space of said pouch while the helmet is being worn by a wearer and without having to remove said helmet from said wearer; and wherein the engaging of the surface of the flap on the second panel to the surface of the first panel to provide a waterproof seal is from engagement of said surfaces immediately adjacent to or coincident with the opening and a thickness of the second panel being greater than said fold line, and said surfaces being made of a waterproof material.

2. The helmet of claim 1, further comprising an information form removably retained within the interior space.

3. The helmet of claim 2, wherein the information form is retained within in the interior space below the terminal edge.

4. The helmet of claim 1, wherein the flap is integrally formed with the second panel and extends from the fold line of the second panel.

5. The helmet of claim 1, wherein the fold line is thinner than each of the flap and the second panel.

6. The helmet of claim 1, wherein the flap is tapered from the fold line of the second panel to an end of the flap so that the opening is wider than the end of the flap for ease of insertion of the flap into and removal of the flap from the opening.

7. The helmet of claim 1, wherein the information carrier is affixed to the exterior surface of the protective head covering so that the opening is positioned toward the rear of the helmet.

8. The helmet of claim 1, wherein the adhesive affixes substantially all of an outer surface of the first panel to the exterior surface of the protective head covering.

9. The helmet of claim 8, wherein the outer surface is affixed to the exterior surface up to the terminal edge of the first panel.

10. The helmet of claim 1, wherein a portion of an outer surface of the flap between the fold line and the terminal edge is disposed proximately to and facing the exterior surface of the protective head covering in an inserted position.

* * * * *